US006840315B2

(12) United States Patent
Jarchau et al.

(10) Patent No.: US 6,840,315 B2
(45) Date of Patent: Jan. 11, 2005

(54) DEVICE FOR CLEANING AN INNER PIPE INSERTED INTO A GAS OR OIL PRODUCING WELL

(75) Inventors: Michael Jarchau, Oelde (DE); Egbert Helmig, Ennigerloh (DE)

(73) Assignee: Hammelmann Maschinenfabrik, Oelde (DE)

( * ) Notice: Subject to any disclaimer, the term of this patent is extended or adjusted under 35 U.S.C. 154(b) by 0 days.

(21) Appl. No.: 10/628,807

(22) Filed: Jul. 28, 2003

(65) Prior Publication Data

US 2004/0016540 A1 Jan. 29, 2004

Related U.S. Application Data

(63) Continuation of application No. PCT/EP02/10356, filed on Sep. 16, 2002.

(30) Foreign Application Priority Data

Sep. 17, 2001 (DE) ..... 101 45 854

(51) Int. Cl.[7] ..... E21B 37/00

(52) U.S. Cl. ..... 166/223; 166/169; 239/225.1; 239/251

(58) Field of Search ..... 166/222, 223, 166/108, 110, 169; 175/424; 239/225.1, 227, 251, 252, 256–258

(56) References Cited

U.S. PATENT DOCUMENTS

| | | | | |
|---|---|---|---|---|
| 4,677,997 A | | 7/1987 | Strauss | |
| 4,919,204 A | | 4/1990 | Baker et al. | |
| 5,195,585 A | | 3/1993 | Clemens et al. | |
| 5,236,126 A | * | 8/1993 | Sawade et al. | 239/252 |
| 5,909,848 A | * | 6/1999 | Zink | 239/252 |

FOREIGN PATENT DOCUMENTS

| | | |
|---|---|---|
| DE | 19034092 | 3/1966 |
| DE | 3412319 C1 | 6/1985 |

* cited by examiner

*Primary Examiner*—Zakiya Walker
(74) *Attorney, Agent, or Firm*—Gauthier & Connors LLP

(57) ABSTRACT

A device for cleaning an inner pipe which comprises a nozzle head comprised of a feed borehole axially disposed therein, at least two rotation nozzles communicating with the feed borehole, at least two cleaning nozzles communicating with the feed borehole and a shaft. A rinsing nozzle communicates with the feed borehole and extends upwardly at an angle from the longitudinal axis of the feed borehole. The shaft is received in an outer sleeve whereby when the device is inserted into an inner pipe and a medium is flowed through the borehole and out of the rotation nozzles a force is generated when the medium emerging from the rotation nozzles contacts the wall of the inner pipe which force causes the nozzle head to rotate.

21 Claims, 4 Drawing Sheets

DEVICE FOR CLEANING AN INNER PIPE INSERTED INTO A GAS OR OIL PRODUCING WELL

PRIORITY DATA

This application is a continuation of International Application No. PCT/EP02/10356, filed on Sep. 16, 2002, which International Application claims priority to German Patent Application No. 101 45 854.1, filed on Sep. 17, 2001.

BACKGROUND OF THE INVENTION

The present invention relates to a device for cleaning an inner pipe inserted into a gas- or oil-producing well. During gas or oil production, impurities are deposited onto the inner wall of the inner pipe that lines a gas or oil-producing well. In order to ensure efficient flow of the gas or oil the deposited impurities need to be removed on a consistent basis.

Thus far, impurities have been removed by the application of chemical agents to the inner to the inner wall of the inner pipe which results in the loosening of clinging grime. For many reasons, however, the use of the chemicals to remove the impurities is less than satisfactory. For example, such chemicals are a burden on the environment and can be harmful to users of the chemicals, e.g., the cleaning personnel. In addition, the use of chemicals to remove the impurities not only is time consuming but also requires the requires the cessation of flow of the gas or oil through the pipe which hampers production.

In view of the aforementioned disadvantages associated with chemical cleaning, attempts have been made to mechanically remove the impurities from the inner pipe using mechanical devices, e.g., whereby spray nozzles are introduced into the inner pipe. However, these spray nozzles did not have the necessary mechanical stability and reliability to accomplish the removal of the impurities from the inner pipe in an economical way.

In use, the mechanical devices are difficult to access and monitor and are subjected to high temperatures and atmospheres having high moisture content. Moreover, the mechanical devices are expected to function in dirt, sand, rocks, fluids and in work spaces that cramped while bearing extreme impact loads in the horizontal and transverse direction. Traditional mechanical devices have not been suitable for removing the impurities from the inner pipe for the following reasons: (1) the bearings of the mechanical devices are easily damaged due to overly small dimensioning and impact strain, as well as penetration of dirt; (2) the seals of the mechanical devices fail due to abrasion by foreign particles; (3) the rotors of the mechanical devices break due to excessive loading, lateral forces, and dynamic impact loading; (4) the components of the mechanical devices easily fragmented and broken; and (5) the brake system of the mechanical devices are exposed to excessive heat. In addition to the aforementioned drawbacks, the use mechanical devices can result in the fouling of the wall of the inner pipe and the clogging of the inner pipe, e.g., when so-called bridges form, in which particles of dirt are baked together in a layer which substantially closes off the cross section of the inner pipe. When bridges form, tools other than the mechanical devices, e.g., drills, must be used to unclog the inner pipe thereby adding costs to the impurity removal process.

Therefore, a need exists for a mechanical device having a compact design that functions efficiently in the aforementioned extreme conditions, e.g., a work space having small diameters and without the aforementioned problems associated with traditional mechanical devices.

BRIEF SUMMARY OF THE INVENTION

Broadly, the invention comprises a device for cleaning an inner wall which comprises a rotatable nozzle head. Extending axially into the nozzle head is a central feed borehole. Depending from the central feed borehole is at least one slanted cleaning nozzle. An outer sleeve is rotatably mounted to the nozzle head and has an inwardly conically tappering inner thread into which a hollow rod can be screwed. The hollow rod provides a conduit through which a medium, usually water, is flowed to the central feed borehole and also can serve as a holder for the cleaning mechanism.

In one aspect, the invention also comprises at least two rotation nozzles which are disposed at opposite sides of the central feed borehole. Their exit axes lie at a distance from the center axis of the nozzle head. As the medium is flowed through the central feed borehole and out through the rotation nozzles, a torque is produced when the emerging medium contacts opposite sides of the inner wall thereby rotating the nozzle head.

The rotation nozzles also serve to clean the wall of the inner pipe. Preferably, the rotation nozzles are disposed so that the emerging jet of medium impinges perpendicularly on the wall of the inner pipe.

In another aspect of the invention, the nozzle head is formed as a shaft in extension wherein an axially extending feed borehole is provided through which the medium can be introduced into the cleaning and rotating nozzles.

In yet another aspect of the invention, the shaft is rotatably mounted in an outer sleeve and the outer sleeve is joined, e.g., threaded, to the hollow rod. The outer sleeve has an inner thread opposite the nozzle head into which an outer thread of the hollow rod can be screwed.

In another aspect of the invention, the threaded shaft of the hollow rod is conical in shape, like the inner thread of the outer sleeve, thereby facilitating the attachment and detachment of the hollow rod from the outer sleeve.

In yet another aspect of the invention, the device includes at least one rinsing nozzle which is arranged such that it is stationary with respect to the rotating nozzle head and lies within the outer sleeve. The rinsing nozzle functions as an axial drive for the overall cleaning mechanism by virtue of their recoil and expel the sludge loosened by the cleaning nozzles and the rotation nozzles. When more than one rinsing nozzle and cleaning nozzle is used, the rinsing nozzles, as with the cleaning nozzles, are preferably uniformly distributed about the circumference of the central feed bore.

By mounting the nozzle head or the adjoining shaft in the outer sleeve, which can be relatively thin-walled, relatively large-sized bearings, which can withstand large forces, are used to ensure suitable operation of the device in harsh environments.

In one aspect of the invention, the shaft and the nozzle head are constructed to form a single piece whereby the shaft of the single piece is enclosed by the outer sleeve.

The shaft is secured in the outer sleeve at several points, e.g., with shoulders or radial securing elements, preferably screws, in order to prevent disassociation of the nozzle head from the outer sleeve.

In yet another aspect of the invention, a shoulder of an inner ring, bearing against the shaft and an intermediate sleeve, transmits axial hydraulic forces. The shaft is screwed into both the intermediate sleeve and the inner ring lying above it. Upon fracture of the shaft at its weakest cross section, between the connection areas with the intermediate sleeve and the inner ring, the front part of the shaft will be held by the shoulder of the intermediate sleeve, resting against a bearing. If the next larger cross section breaks beneath the connection to the intermediate sleeve, the radial securing screws will hold the front fragment against the stationary outer sleeve.

In yet another aspect of the invention, a water outlet through which water is supplied from the central feed borehole is disposed in the transitional region between the outer sleeve and the nozzle head. The flow of water through the water outlet provides a water film in the transitional region, which is in the form of a gap, thereby preventing dirt from the outside from entering this gap and thus into the connection region between the shaft and the outer sleeve. This provides a seal which protects the bearing behind it. This seal is protected against penetration of dirty water or mud by the film which forms a barrier.

In another aspect of the invention, at least two water outlets are provided. The water outlets are uniformly distributed about the circumference of the central feed bore and can be directed in a manner such that they are parallel to the rotation nozzles, i.e., transverse to the lengthwise axis of the device, or optionally parallel to the rinsing nozzles such that they are upwardly slanted when in the functional position.

In yet another aspect of the invention, at least two water outlet openings are provided and are arranged eccentrically to produce a force which supports the recoil of the rotation nozzles.

In another aspect of the invention, a combination of water outlets is provided wherein upwardly slanted nozzles are combined with eccentrically arranged nozzles.

In another aspect of the invention, a vortex brake is disposed between the shaft and the outer sleeve in order to adjust the rotational speed of the nozzle head. The vortex brake comprises annular magnets that are fully encapsulated and stationary thereby forming a stator. The outer housing is comprised of a magnetic material, preferably a stainless steel. Escaping leakage water is taken through the gap occurring between the stator formed by the magnets and the inwardly-located rotor such that the vortex brake can be efficiently cooled.

In order to match the speed of the nozzle head to a particular circumstance the braking torque of the vortex brake can be changed. To change the braking torque of the vortex brake, rings, which enclose the rotor of the vortex brake (the inner ring) and against which the stator thrusts, can be inserted or removed thereby altering the axial position of the stator relative to the rotor and, thus, the overlap region between the two.

In yet another aspect of the invention, a central plunger is provided in the nozzle head. The central plunger is adapted for axial movement and at the front end thereof protrudes beyond the nozzle head. The plunger, which is spring-loaded, is forced axially into the nozzle head against the spring force by the pressure force of the medium when, for example, a blockage has occurred in the inner pipe of the gas- or oil-producing well.

In this case, when the plunger is inserted, the plunger body closes the supply openings to the cleaning nozzles and the medium is guided to jet nozzles, which are grouped at the front end of the nozzle head around the plunger exit opening. The water emerging at high pressure loosens the blockage and then the plunger is moved back into its original position by the compression spring and the pressure force of the medium. The cleaning nozzles are again released and the jet nozzles are closed.

In order to damp the impacts occurring during the operation of the device, which can contribute to significant wear on the cleaning mechanism, the shaft of the nozzle head is comprised of at least two parts, one of which that is joined to the nozzle head and is adapted for axially movement relative to the other part. A damping chamber is provided between the two parts wherein the water functions as a damping agent.

In another aspect, the invention comprises seals disposed between the shaft and the outer sleeve to protect the interior bearings. However, the seals can be omitted if the bearings used are corrosion proof and are lubricated with water, e.g., the water used to cool the vortex brake.

These and other objects, features and advantages of the present invention will become more apparent in light of the following detailed description of the preferred embodiments thereof, as illustrated in the accompanying drawings.

DETAILED DESCRIPTION OF THE INVENTION

Figure 1:
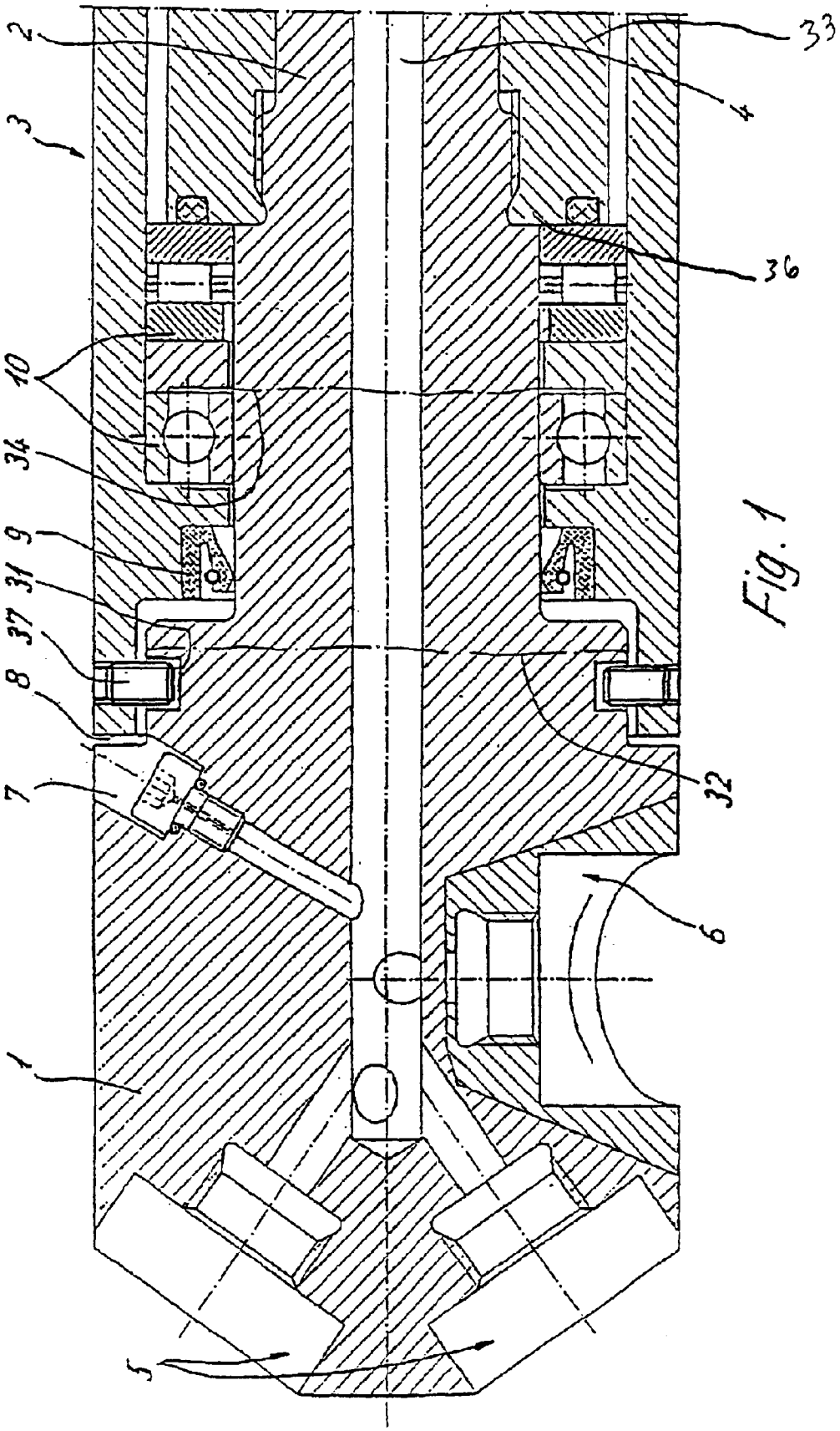
FIG. 1 is longitudinal sectional view of the upper half of a device embodying the invention.
Figure 2:
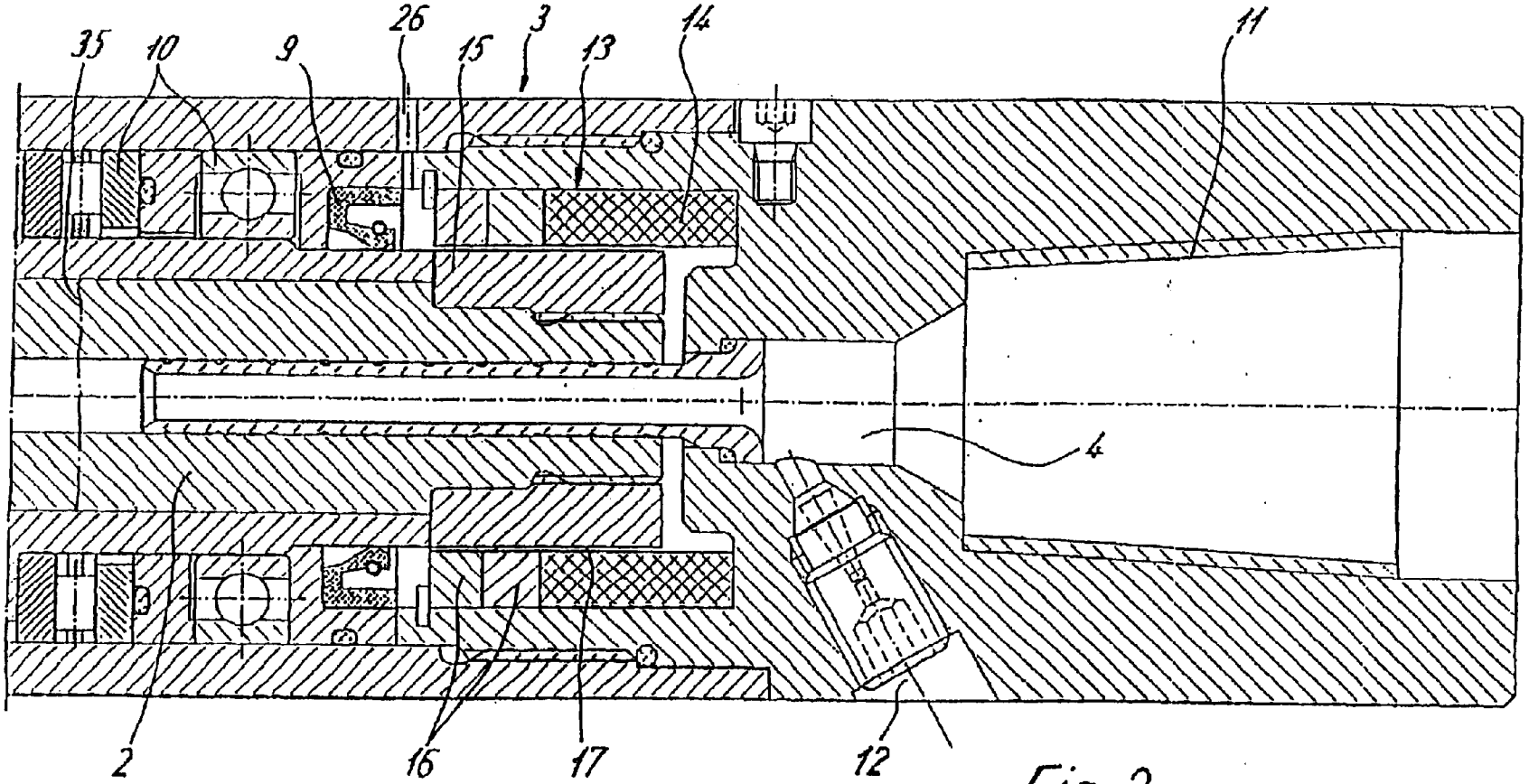
FIG. 2 is a longitudinal sectional view of the lower half of the device shown in FIG. 1.

Referring to FIGS. 1 and 2, the device for cleaning an inner wall has a rotating nozzle head 1 and an outer sleeve 3 rotatably mounted in the nozzle head 1. At one end of the nozzle head 1, the outer sleeve 3 is provided with an inwardly conically tapering inner thread 11 into which a hollow rod can be screwed. The hollow rod guides a medium under pressure, e.g., water, through a central feed borehole 4. The central feed borehole 4 extends axially into the nozzle head 1.

The nozzle head 1 comprises at least two cleaning nozzles 5 which are, preferably, uniformly distributed within the nozzle head. The nozzle head 1 passes into a shaft 2, which is mounted in the outer sleeve 3, for which bearings 10 are provided in the form of two radial and two axial bearings, the latter preferably of cylindrical roller bearing type.

In another embodiment of the invention, additional cleaning nozzles (not shown) are directed centrally and diagonally relative to the lengthwise axis within the nozzle head in a like manner as that shown for the cleaning nozzles 5 excepting that the additional cleaning nozzles are positioned such that they are slanted upwardly in the opposite direction from the downwardly slanted cleaning nozzles 5.

The nozzle head 1 has rotation nozzles 6 which are disposed in pairs eccentrically opposite to each other and directed to the sides of the nozzle head 1. The axes of the rotation nozzles 6 make a right angle with the lengthwise axis of the nozzle head 1. The oppositely directed positioning of the rotation nozzles 6 provides a torque when the water is flowed through rotation nozzles which torque places the nozzle head 1 in rotation.

Bearings 10 are protected by a seal in the direction of the nozzle head 1 which thrusts against the outer sleeve 3 and the against the shaft 2.

A gap 8 is provided between the end face of the outer sleeve 3 and the nozzle head 1 for facile turning of the nozzle head 1. A water outlet 7, which is supplied with the water, via the feed borehole 4, builds a liquid barrier in the gap 8 thereby preventing dirt from inner pipe from entering into the area of the seal 9.

At the end of the outer sleeve 3 opposite the nozzle head 1 there are rinsing nozzles 12 placed diagonally to and in the opposite direction of the cleaning nozzles 5. The water under pressure emerges from these rinsing nozzles 12 in a like manner as the cleaning nozzles and rotation nozzles resulting in a repulsion that produces an axial driving of the device and carries away the dirt loosened by the cleaning nozzles 5.

Referring to FIG. 2, a vortex brake 13 is shown which produces a constant rotational speed of the nozzle head 1. The vortex brake 13 is comprised of an inner ring 15 which is secured to the shaft 2 thereby functioning as a rotor. The outer diameter of the inner ring 15 is the same size as or larger than that of the shaft 2. This ensures axial securing of the nozzle head 1 in the event that the fasteners, e.g., the screw fastenings, which secure the nozzle head 1 or the shaft 2 in the outer sleeve 3 are tom off. Fully encapsulated magnets 14 axially surround at least a portion of the inner ring 15 to form a stator. The operation of the vortex brake 13 can be influenced by rings 16 which surround the inner ring 15 and support the magnets 14. The number of rings 16 will determine the overlap surface of the magnets 14 and the inner ring 15 thus changing the resistance to turning of the inner ring 15.

A gap 17 is formed between the magnets 14 and the inner ring 15 and the magnets 14 and the rings 16 through which leakage water is guided for purposes of cooling and carried to the outside via an exit opening 26.

In another embodiment of the invention, the rinsing nozzles 12 are arranged in the vicinity of the nozzle head 1 such that the rinsing nozzles 12 will rotate with the nozzle head 1 upon rotation of the nozzle head 1.

Figure 3:
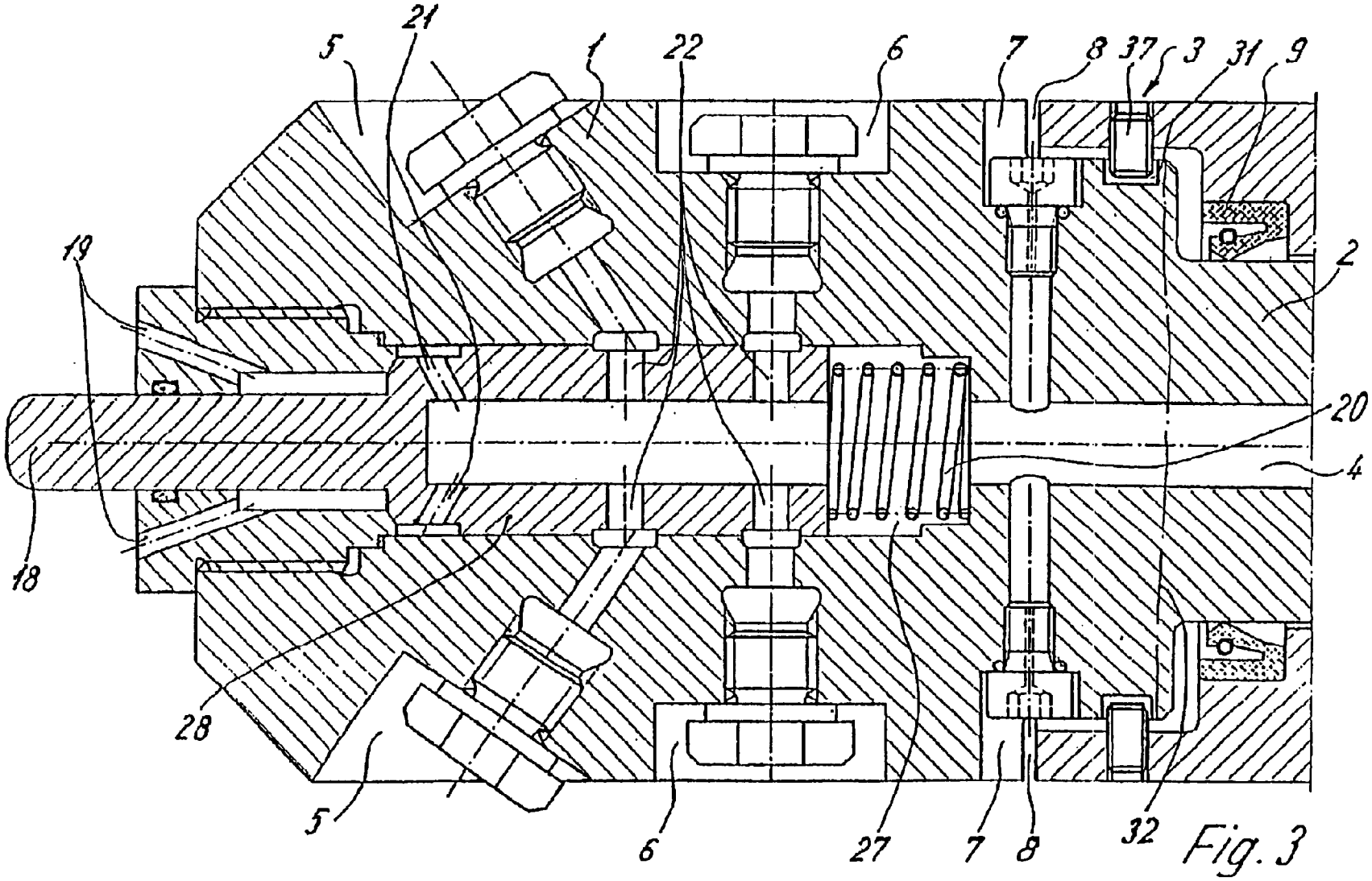
FIG. 3 is longitudinal sectional view of an alternative embodiment of the device shown in FIG. 1.

Referring to FIG. 3, an alternative embodiment of the invention is shown in which the nozzle head 1 has an axially moveable, centrally disposed, spring-loaded plunger 18 comprised of a plunger body 28, having an end which protrudes from the end face of the nozzle head 1. At the opposite end of the plunger there is disposed a compression spring 20 having one end which thrusts against the bottom of a recess 27 in the nozzle head 1 and having another end thrusted against the plunger body 28. The plunger body 28 is adapted to move axially in the recess 27.

Jet nozzles 19 which, like the cleaning nozzles 5, are directed in an outwardly diagonal manner, are disposed concentrically to the plunger 18.

In operation, when the plunger 18 encounters an obstacle, such as a blockage in an inner pipe of a gas- or oil-producing well, the device will continue to advance axially relative to the nozzle head 1 pushing the plunger 18 inwardly against the force of the compression spring 20. The feed channels to the cleaning nozzles 5 and optionally the rotation nozzles 6, which otherwise communicate with the feed borehole 4 via channel boreholes 22, will then be closed by the plunger body 28, while a flow to the jet nozzles 19 will be opened up, whereupon the water flowing from the feed borehole 4 will be taken via channel boreholes 21 to the jet nozzles 19. When the force acting on the plunger 18 ceases, for example by of the blockage due to the water emerging from the jet nozzles 19, the plunger will be pushed by virtue of the spring force and the pressure force of the medium into its non-operating position wherein the jet nozzles 19 are closed. In the non-operating position, the passageway to the cleaning nozzles 5 and rotation nozzles 6 is again opened up since the channel boreholes 22 are aligned with the feed channels going to the cleaning and rotation nozzles.

In an alternative embodiment, a central nozzle can be provided instead of, or in combination with, the jet nozzles 19 for eliminating blockages in the inner pipe.

Figure 4:
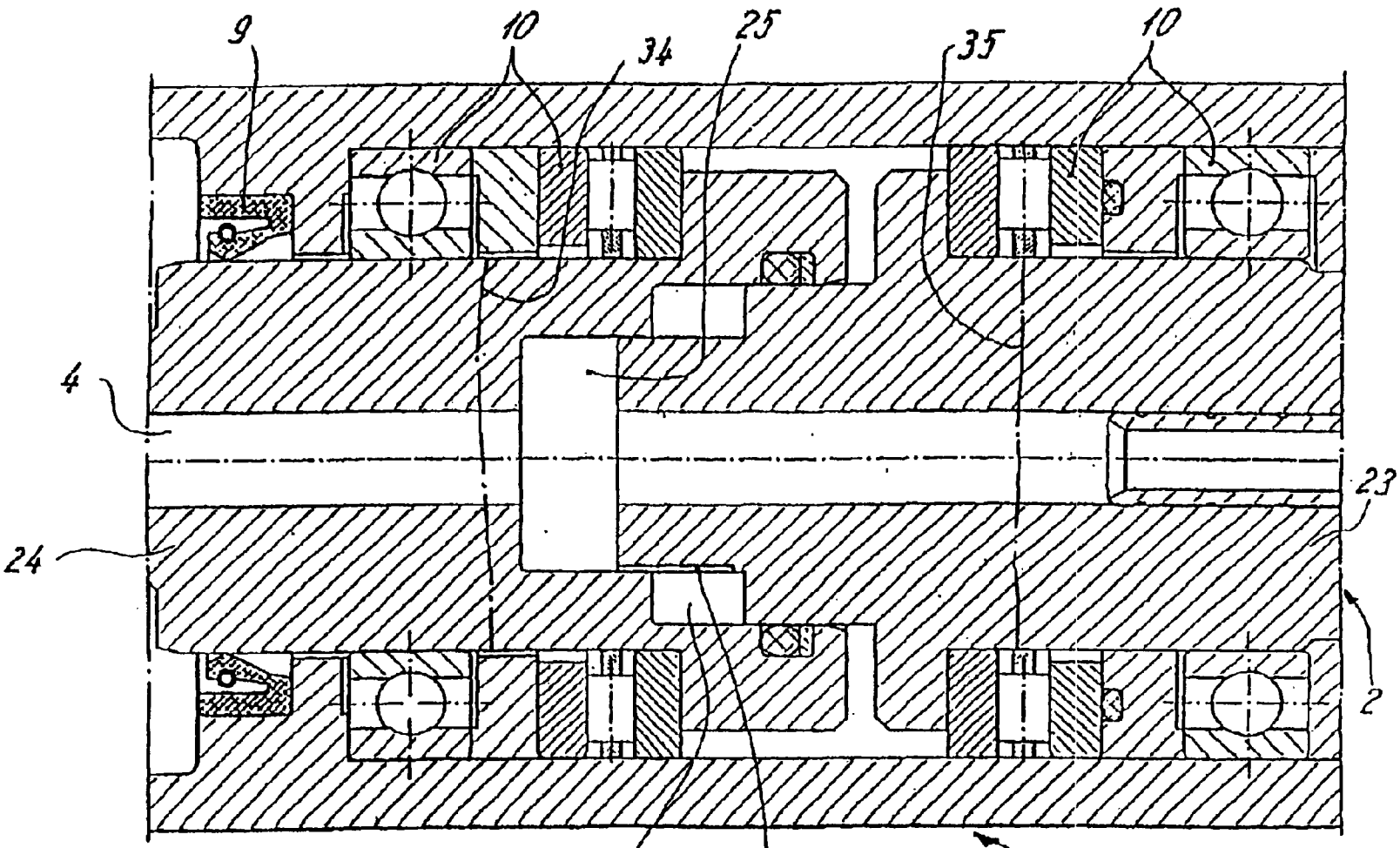
FIG. 4 is a longitudinal sectional view of yet another alternative embodiment of the device shown in FIG. 1.

Referring to FIG. 4, another embodiment of the device is shown wherein the shaft 2 comprises two shaft parts 23, 24. The shaft parts 23, 24 are connected such that each part can move axially relative to one another but are prevented from twisting relative to one another. In this configuration, the shaft 2 functions as a single piece.

In the vicinity of the feed borehole 4, between the two shaft parts 23, 24, a chamber 25 is formed which communicates via a damping gap 30 with a damping chamber 29 such that both chambers are filled with water during operation.

When an impact load acts on the nozzle head and thus on the shaft part 24, the shaft part 24 is moved axially relative to the shaft part 23 while at the same time expelling water into the damping chamber 29 through the damping gap 30 into the chamber 25 thereby achieving an optimal shock-absorbing action.

In event of an accident, neither the nozzle head 1 nor the parts of the shaft 2 must enter the producing well being cleaned. In event of a fracture of the shaft 2 in the smallest shaft cross section 35, above a screw fastening region with an intermediate sleeve 33, the shaft is no longer held by the inner ring 15. In this situation, the broken pieces are held on the stationary outer sleeve 3 by the intermediate sleeve 33 and its shoulder 36, which thrusts against one of the bearings 10, the axial bearing, and in which the shaft 2 is screwed.

If the shaft 2 breaks in the middle cross section 34, beneath the connection to the intermediate sleeve 33, the remaining pieces are held via radial securing elements 37, which can be comprised of radially arranged screws, which are fastened in the outer sleeve 3 and which project into a groove 31 of the rotating nozzle head 1, so that the largest shaft cross section 32 determines the risk of a loss.

Although the present invention has been shown and described with a preferred embodiment thereof, various changes, omissions and additions to the form and detail thereof, may be made therein, without departing from the spirit and scope of the invention.

What is claimed is:

1. A device for cleaning an inner pipe which comprises:

a nozzle head comprised of a feed borehole axially disposed therein, at least two rotation nozzles communicating with the feed borehole and extending perpendicularly from the longitudinal axis of the feed borehole, at least two cleaning nozzles communicating with the feed borehole and extending downwardly at an angle from the longitudinal axis of the feed borehole,;

and a shaft;

a rinsing nozzle communicating with the feed borehole and extending upwardly at an angle from the longitudinal axis of the feed borehole; and an outer sleeve adapted to receive a hollow rod, the shaft being received in the outer sleeve whereby when the device is inserted into an inner pipe and a medium is flowed through the borehole and out of the rotation nozzles a force is generated when the medium emerging from the rotation nozzles contacts the wall of the inner pipe which force causes the nozzle head to rotate, the outer sleeve comprising a first means for preventing the nozzle head from descending into the inner pipe disjoined from the outer sleeve when the nozzle head has a first break, the cross-section of which lies above the first means for preventing and a second means for preventing the nozzle head from descending into the inner pipe disjoined from the outer sleeve when the nozzle head has a second break, the cross-section of which lies above the second means for preventing, the first means for preventing comprising an intermediate sleeve interposed between the outer sleeve and the shaft, the intermediate sleeve having a shoulder that prevents the nozzle head from descending into the pipe disjoined from the outer sleeve when the nozzle head has the first break.

2. The device of claim 1 which further comprises a first and second radial bearing and a first and second axial bearing, the bearings being disposed between the shaft and the outer sleeve.

3. The device of claim 2 wherein the radial bearings are cylindrical.

4. The device of claim 3 wherein the firs means for preventing intermediate sleeve is positioned above the first radial and axial bearings.

5. The device of claim 4 wherein the shaft further comprises an annular groove and the second means for preventing comprises a protuberance that is secured to the outer sleeve and projects into the annular groove, the protuberance being positioned below the second radial and axial bearings, the protuberance the nozzle head from descending into the pipe disjoined from the outer sleeve when the nozzle head has the second break.

6. The device of claim 2 wherein the bearings are comprised of stainless steel, the bearings being adapted to be cooled by the medium when the medium is provided between the nozzle head and the outer sleeve.

7. The device of claim 1 wherein the nozzle head further comprises:

at least one water outlet in communication with the feed borehole and positioned upwardly from the longitudinal axis of the feed borehole; and a gap formed in between the water outlet and the outer sleeve, the gap being filled with medium when the medium is flowed through the feed borehole and emerges out of the water outlet.

8. The device of claim 1 wherein the shaft comprises a first part and a second part, the first part being received in the second part and being constructed and arranged to allow axial movement of the second part within the first part and to prevent rotational movement of the second part within the first part.

9. The device of claim 8 wherein the shaft further comprises a damping chamber in communication with a chamber, the damping chamber communicating with the chamber through a damping gap.

10. The device of claim 1 wherein the nozzle head further comprises:

an aperture;

a recess having a top end;

a plunger comprised of a base and a tip and disposed within the recess; and means for biasing the plunger in a first position wherein the tip extends through the aperture and outwardly from the nozzle head.

11. The device of claim 10 wherein the nozzle head further comprises a spring having a first end and a second end, the first end contacting the base and the second end contacting the top end whereby when a force is applied to the tip and the plunger is in the first position, the spring compresses allowing the plunger to move upwardly within the recess to a second position.

12. The device of claim 11 wherein the plunger is concentrically disposed within the nozzle head.

13. The device of claim 11 wherein the nozzle head further comprises at least two jet nozzles positioned within the nozzle head, the jet nozzles being in communication with the feed borehole when the plunger is in the second position thereby allowing the emergence of medium out of the jet nozzles when the medium is flowed through the borehole and being out of communication with the feed borehole when the plunger is in the first position thereby preventing the emergence of medium out of the jet nozzles when the medium is flowed through the borehole.

14. The device of claim 13 wherein the plunger further comprises a plurality of channel boreholes so constructed and arranged to allow the flow of medium through the channel boreholes to the rotation nozzles or optionally the cleaning nozzles or optionally the rotation nozzles and the cleaning nozzles when the medium is flowed through the feed borehole and the plunger is in the first position.

15. The device of claim 14 wherein the channel boreholes are constructed and arranged to prevent the flow of medium through the channel boreholes to the rotation nozzles or optionally the cleaning nozzles or optionally the rotation nozzles and the cleaning nozzles when the medium is flowed through the feed borehole and the plunger is in the second position.

16. A device for cleaning an inner pipe which comprises:

a nozzle head comprised of a feed borehole axially disposed therein, at least two rotation nozzles communicating with the feed borehole and extending perpendicularly from the longitudinal axis of the feed borehole, at least two cleaning nozzles communicating with the feed borehole and extending downwardly at an angle from the longitudinal axis of the feed borehole,; and a shaft;

a rinsing nozzle communicating with the feed borehole and extending upwardly at an angle from the longitudinal axis of the feed borehole; and an outer sleeve adapted to receive a hollow rod, the shaft being received in the outer sleeve whereby when the device is inserted into an inner pipe and a medium is flowed through the borehole and out of the rotation nozzles a force is generated when the medium emerging from the rotation nozzles contacts the wall of the inner pipe which force causes the nozzle head to rotate, the outer sleeve comprising a first means for preventing the nozzle head from descending into the inner pipe disjoined from the outer sleeve when the nozzle head has a first break, the cross-section of which lies above the first means for preventing and a second means for preventing the nozzle head from descending into the inner pipe disjoined from the outer sleeve when the nozzle head has a second break, the cross-section of which lies above the second means for preventing; and a vortex brake disposed between the shaft and the outer sleeve.

17. The device of claim 16 wherein the vortex brake comprises:

an inner ring enveloping and joined to at least a portion of the shaft;

a first outer ring enveloping at least a portion of the inner ring; and a magnet enveloping at least a portion of the inner ring, the magnet and the first outer ring forming a stator, the rotation of the inner ring within the stator being controlled by the magnetic force being applied to the inner ring from the magnet.

18. The device of claim 17 wherein the vortex brake further comprises a gap formed between the stator and the inner ring, the gap being adapted to receive the medium.

19. The device of claim 18 wherein the magnet comprises at least two magnets encapsulated in a second outer ring.

20. The device of claim 19 wherein the stator comprises a plurality of outer rings that envelop at least a portion of the inner ring, the number of outer rings determining the region that the inner ring is enveloped by the second outer ring.

21. A device for cleaning an inner pipe which comprises:

a nozzle head comprised of a feed borehole axially disposed therein, at least two rotation nozzles communicating with the feed borehole and extending perpendicularly from the longitudinal axis of the feed borehole, at least two cleaning nozzles communicating with the feed borehole and extending downwardly at an angle from the longitudinal axis of the feed borehole, and a shaft;

a rinsing nozzle communicating with the feed borehole and extending upwardly at an angle from the longitudinal axis of the feed borehole;

an outer sleeve adapted to receive a hollow rod, the shaft being received in the outer sleeve whereby when the device is inserted into an inner pipe and a medium is flowed through the borehole and out of the rotation nozzles a force is generated when the medium emerging from the rotation nozzles contacts the wall of the inner pipe which force causes the nozzle head to rotate, the outer sleeve comprising a first means for preventing the nozzle head from descending into the inner pipe disjoined from the outer sleeve when the nozzle head has a first break, the cross-section of which lies above the first means for preventing and a second means for preventing the nozzle head from descending into the inner pipe disjoined from the outer sleeve when the nozzle head has a second break, the cross-section of which lies above the second means for preventing;

wherein the nozzle head further comprises: a front end;

and a central nozzle having an aperture, the central nozzle being in communication with the feed borehole and positioned in the front end whereby when medium is flowed through the feed borehole and emerges out the aperture, the size of the aperture can be adjusted to regulate the flow of the medium therethrough.

* * * * *